US009949582B2

(12) United States Patent
DuDonis

(10) Patent No.: US 9,949,582 B2
(45) Date of Patent: Apr. 24, 2018

(54) FOAM CUSHION COVER

(71) Applicant: Intensive Therapeutics, Inc., Sarasota, FL (US)

(72) Inventor: Matthew DuDonis, Sarasota, FL (US)

(73) Assignee: Intensive Therapeutics, Inc., Sarasota, FL (US)

( * ) Notice: Subject to any disclaimer, the term of this patent is extended or adjusted under 35 U.S.C. 154(b) by 115 days.

(21) Appl. No.: 15/206,233

(22) Filed: Jul. 9, 2016

(65) Prior Publication Data

US 2018/0008064 A1 Jan. 11, 2018

(51) Int. Cl.

| | |
|---|---|
| ***A47G 9/10*** | (2006.01) |
| ***A47G 9/02*** | (2006.01) |
| ***A47C 20/00*** | (2006.01) |
| ***A61G 7/075*** | (2006.01) |

(52) U.S. Cl.

CPC ..... *A47G 9/0253* (2013.01); *A47C 20/021* (2013.01); *A47G 9/10* (2013.01); *A61G 7/0755* (2013.01); *A47G 2009/1018* (2013.01)

(58) Field of Classification Search

CPC ..... A47G 9/10; A47G 2009/1018; A47G 9/0253; A47G 9/0238; A47C 7/383; A47C 7/38; A47C 27/088; A47C 27/084; A47C 27/18; A47C 31/08

USPC ... 5/490, 636, 640, 645, 632, 630, 652, 657, 5/709, 708, 703

See application file for complete search history.

(56) References Cited

U.S. PATENT DOCUMENTS

| | | | | | |
|---|---|---|---|---|---|
| 897,979 | A * | 9/1908 | Holding | A47C 31/08 | 16/422 |
| 1,731,530 | A * | 10/1929 | Goldeen et al. | A47C 31/08 | 16/444 |
| 2,460,452 | A * | 2/1949 | Hampton | A47G 9/0253 | 5/490 |
| 2,997,100 | A * | 8/1961 | Morris | A47C 27/081 | 5/708 |
| 3,017,642 | A * | 1/1962 | Rosenberg et al. | A47C 27/084 | 297/DIG. 3 |
| 3,042,941 | A * | 7/1962 | Marcus | A47C 27/18 | 5/708 |
| 3,133,696 | A * | 5/1964 | Mirando | A47C 27/081 | 137/846 |
| 3,389,411 | A * | 6/1968 | Emery | A47C 21/022 | 428/71 |
| 5,033,133 | A * | 7/1991 | Nissen | A47C 7/021 | 5/653 |

(Continued)

*Primary Examiner* — Robert G Santos

(74) *Attorney, Agent, or Firm* — Rahman LLC

(57) ABSTRACT

A cushion cover includes a first chamber that includes at least one sheet, wherein the first chamber is configured to house a cushion that includes air pockets. A second chamber is sealed to the first chamber, wherein the second chamber includes a closed back end, a closed top, a closed bottom, a pair of closed sides, and an open front end. A panel, which includes at least one hole, is sealed to the first chamber and facing the open end of the second chamber. A handle is provided that includes a longitudinal strap adjoining a pair of side panels, wherein the pair of side panels are sealed to the first chamber, wherein upon a force being applied to the first chamber, air contained in the air pockets of the cushion flows through the at least one hole in the panel and into the second chamber without exiting the second chamber.

20 Claims, 8 Drawing Sheets

(56) References Cited

U.S. PATENT DOCUMENTS

| | | | | | |
|---|---|---|---|---|---|
| 5,507,049 | A * | 4/1996 | Lane | A47C 20/021 | 5/484 |
| 5,632,055 | A * | 5/1997 | Graf | A47C 27/081 | 5/706 |
| 5,746,873 | A * | 5/1998 | Graf | A47C 27/081 | 156/274.4 |
| 5,864,907 | A * | 2/1999 | Hutton | A47C 31/08 | 16/DIG. 28 |
| 5,937,463 | A * | 8/1999 | Hutton | A47C 31/08 | 16/DIG. 28 |
| 6,012,188 | A * | 1/2000 | Daniels | A47C 7/021 | 297/284.6 |
| 6,611,981 | B1 * | 9/2003 | Lin | A47C 27/081 | 5/413 AM |
| 6,634,045 | B1 | 10/2003 | DuDonis et al. | | |
| 7,240,384 | B2 | 7/2007 | DuDonis | | |
| 2003/0182727 | A1 * | 10/2003 | DuDonis | A47C 20/021 | 5/648 |
| 2005/0005358 | A1 * | 1/2005 | DuDonis | A47C 20/027 | 5/632 |
| 2008/0178390 | A1 * | 7/2008 | DuDonis | A47C 20/021 | 5/632 |
| 2018/0008064 | A1 * | 1/2018 | DuDonis | A47G 9/0253 | |

* cited by examiner

FOAM CUSHION COVER

BACKGROUND

Technical Field

The embodiments herein generally relate to medical devices, and more particularly to foam cushion covers.

Description of the Related Art

The proper positioning of an immobile patient in a health care setting is a very important task. Patients must be positioned at the proper angle of turn and any device used to assist with supporting the patient must stay in place for the duration of time prescribed by the clinical staff. One device used to support patients in the elevated side lying position is a polyurethane foam wedge cushion. Foam wedges are available in a wide variety of dimensions, densities, and colors. Foam wedges are also available in bare foam or with a cover, which is intended to make the cushion easy to clean and reuse from one patient to another. Cover designs currently available offer some protection to the foam wedge inside the cover, but there are limits to how well the cushion can be sealed from contact with fluid and air contamination.

The most common method of joining the panels of the cover together is sewing. Sewing is fast and very cost effective, but the stitching creates small holes in the fabric and leaves very small gaps between the two pieces of fabric being joined. Fluid and air can pass through these very small spaces and inspections for permeation are difficult to do and are rarely done in the care environment. Another method of joining fabric panels together to form a cover is ultrasonic or radio frequency (RF) welding. This method uses a special adhesive and high frequency (HF) energy to join fabrics together and is the preferred approach because it does not leave small spaces like those found in sewn seams.

Whether a manufacturer chooses to use the sewing method or HF welding to join the seams of a foam cushion cover, the foam must maintain the ability to displace air. Polyurethane foam is an open celled structure that performs as a cushion by supporting with air and displacing air. Cushion covers sewn with seams permit the displacement of air through the small spaces in the seams. Both sewn and HF welded covers often use zipper enclosures, which permit airflow between the teeth of the zipper and through the spaces at either end of the zipper. If the cover is completely sewn or welded, a mesh or metal vent must be used to allow air to flow into and out of the cushion. Sewn seams, zipper enclosures, and vents all present the same potential for air and fluid borne pathogens to enter into the foam cushion. If the cushion becomes contaminated there is a high risk of spreading infection from one user to another within the healthcare environment. Accordingly, there is a need for a new type of foam cushion cover that reduces and/or eliminates the risk of cushion contamination and the spread of infectious pathogens.

SUMMARY

In view of the foregoing, an embodiment herein provides a cushion cover comprising a first chamber comprising at least one sheet, wherein the first chamber is configured to house a cushion comprising air pockets; a second chamber sealed to the first chamber, wherein the second chamber comprises a closed back end, a closed top, a closed bottom, a pair of closed sides, and an open front end; a panel sealed to the first chamber and facing the open end of the second chamber, wherein the panel comprises at least one hole; and a handle comprising a longitudinal strap adjoining a pair of side panels, wherein the pair of side panels are sealed to the first chamber, wherein upon a force being applied to the first chamber, air contained in the air pockets of the cushion flows through the at least one hole in the panel and into the second chamber without exiting the second chamber.

Upon the force being removed from the first chamber, the air contained in the second chamber may flow through the at least one hole in the panel and into the air pockets of the cushion. The cover may further comprise a plurality of edges along the first chamber, the second chamber, the panel, and the pair of side panels of the handle, wherein the plurality of edges may be joined together by high frequency (HF) welding. The open end of the second chamber may comprise a thickness defined by a width of the closed top, the closed bottom, and the pair of closed sides of the second chamber. The thickness may be sufficiently configured to retain expelled air from the cushion without causing the plurality of edges to be opened. Each of the first chamber, the second chamber, the panel, and the handle may comprise HF weldable elastomer material. The cushion may comprise any of a wedge shape, a rectangular shape, a square shape, and a semi-cylindrical shape. The at least one sheet may be devoid of any openings. Each of the first chamber, the second chamber, the panel, and the handle may comprise translucent material. The second chamber may comprise any of a square shape, a rectangular shape, a wedge shape, and a circular shape.

Another embodiment provides a cushion cover comprising a first chamber configured to completely house a cushion, wherein the cushion comprises air pockets; a panel sealed to the first chamber and comprising at least one hole; and a second chamber sealed to any of the panel and the first chamber, wherein the second chamber comprises a collapsible reservoir, wherein upon a force being applied to the first chamber, air contained in the air pockets of the cushion flows through the at least one hole in the panel and into the reservoir of the second chamber without exiting the second chamber.

Upon the force being removed from the first chamber, the air contained in the reservoir of the second chamber may flow through the at least one hole in the panel and into the air pockets of the cushion. The cover may further comprise a plurality of edges along the first chamber, the second chamber, and the panel, wherein the plurality of edges may be joined together by HF welding. The cover may further comprise a handle comprising a longitudinal strap adjoining a pair of side panels, wherein the pair of side panels may be sealed to the first chamber. The reservoir may be sufficiently configured to retain expelled air from the cushion without causing the second chamber to be opened. Each of the first chamber, the second chamber, and the panel may comprise HF weldable elastomer material. The cushion may comprise any of a wedge shape, a rectangular shape, a square shape, and a semi-cylindrical shape. The first chamber may be devoid of any openings. Each of the first chamber, the second chamber, and the panel may comprise translucent material. The second chamber may comprise any of a square shape, a rectangular shape, a wedge shape, and a circular shape.

These and other aspects of the embodiments herein will be better appreciated and understood when considered in conjunction with the following description and the accompanying drawings. It should be understood, however, that the following descriptions, while indicating preferred embodiments and numerous specific details thereof, are given by way of illustration and not of limitation. Many changes and modifications may be made within the scope of the embodiments herein without departing from the spirit thereof, and the embodiments herein include all such modifications.

BRIEF DESCRIPTION OF THE DRAWINGS

The embodiments herein will be better understood from the following detailed description with reference to the drawings, in which.

DETAILED DESCRIPTION

Figure 1:
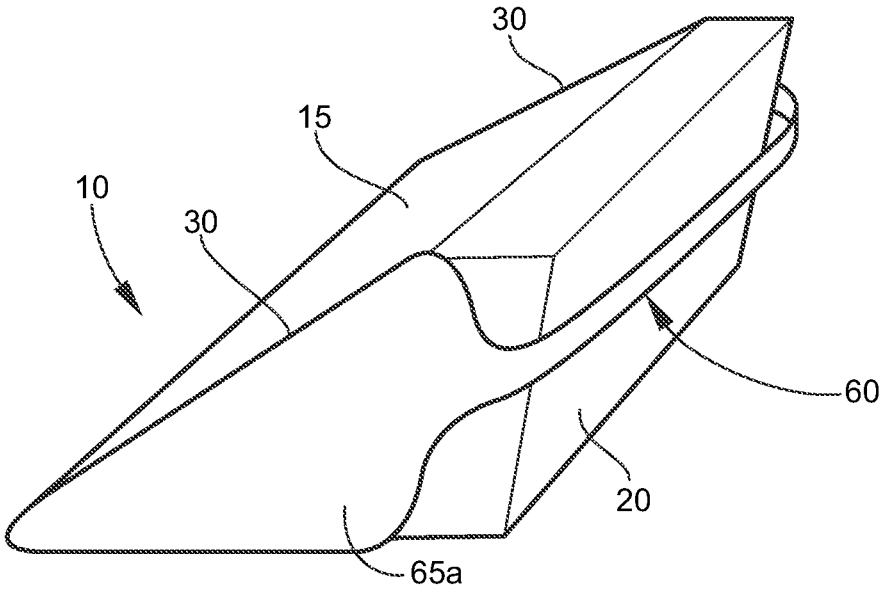
FIG. 1 illustrates a perspective view of a cushion cover according to an embodiment herein.

The embodiments herein and the various features and advantageous details thereof are explained more fully with reference to the non-limiting embodiments that are illustrated in the accompanying drawings and detailed in the following description. Descriptions of well-known components and processing techniques are omitted so as to not unnecessarily obscure the embodiments herein. The examples used herein are intended merely to facilitate an understanding of ways in which the embodiments herein may be practiced and to further enable those of skill in the art to practice the embodiments herein. Accordingly, the examples should not be construed as limiting the scope of the embodiments herein.

As mentioned, there is a need for a new type of foam cushion cover that reduces and/or eliminates the risk of cushion contamination and the spread of infectious pathogens. The embodiments herein provide a completely sealed and closed cover that encapsulates a foam cushion. Referring now to the drawings, and more particularly to FIGS. 1 through 13 where similar reference characters denote corresponding features consistently throughout the figures, there are shown preferred embodiments.

FIG. 1 illustrates a perspective view of a cushion cover 10 according to an embodiment herein. The cushion cover 10 comprises two chambers 15, 20. The first chamber 15 is dimensioned and configured to hold a cushion 25 (of FIG. 4) with HF welded seams 30. A variety of HF weldable elastomer materials can be used to construct the cover 10. For example, the HF weldable elastomer materials may include, but are not limited to, polyvinyl chloride (PVC) and polyurethane. A handle 60 is configured to attach to the two chambers 15, 20 using a pair of side panels 65*a*, 65*b* (fully shown in FIG. 3).

Figure 2:
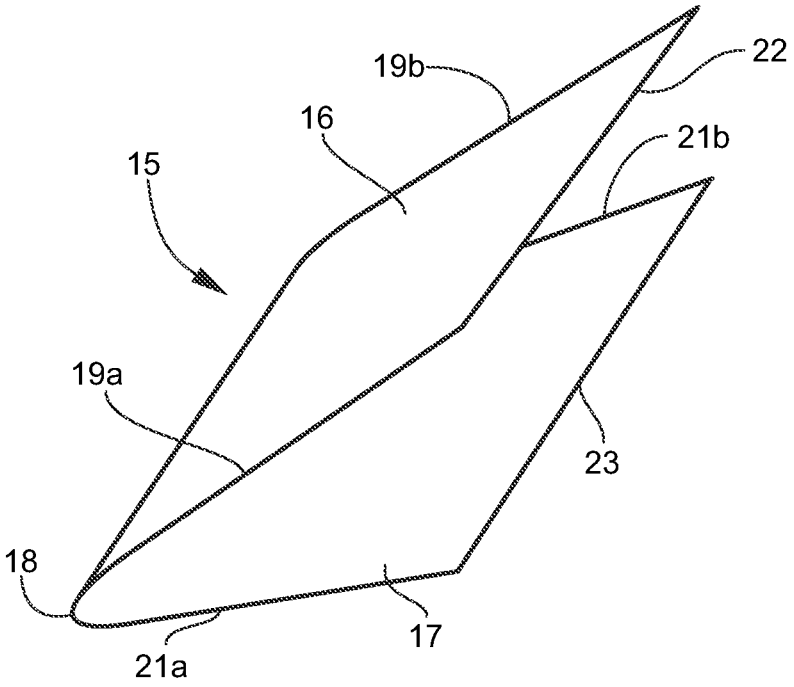
FIG. 2 illustrates a perspective view of the first chamber of the cushion cover of FIG. 1 according to an embodiment herein.

FIG. 2, with reference to FIG. 1, illustrates a perspective view of the first chamber 15 of the cushion cover 10 of FIG. 1 according to an embodiment herein. The first chamber 15 comprises a pair of sheets 16, 17 connected by a spine 18 that is configured in a slightly curved configuration. The first sheet 16 includes a first side edge 19*a*, a second side edge 19*b*, and a lateral edge 22. The second sheet 17 includes a first side edge 21*a*, a second side edge 21*b*, and a lateral edge 23. The spine 18 is positioned opposite from the lateral edges 22, 23. In one embodiment, the first sheet 16, second sheet 17, and spine 18 may be configured as a single folded sheet of fabric.

Figure 3:
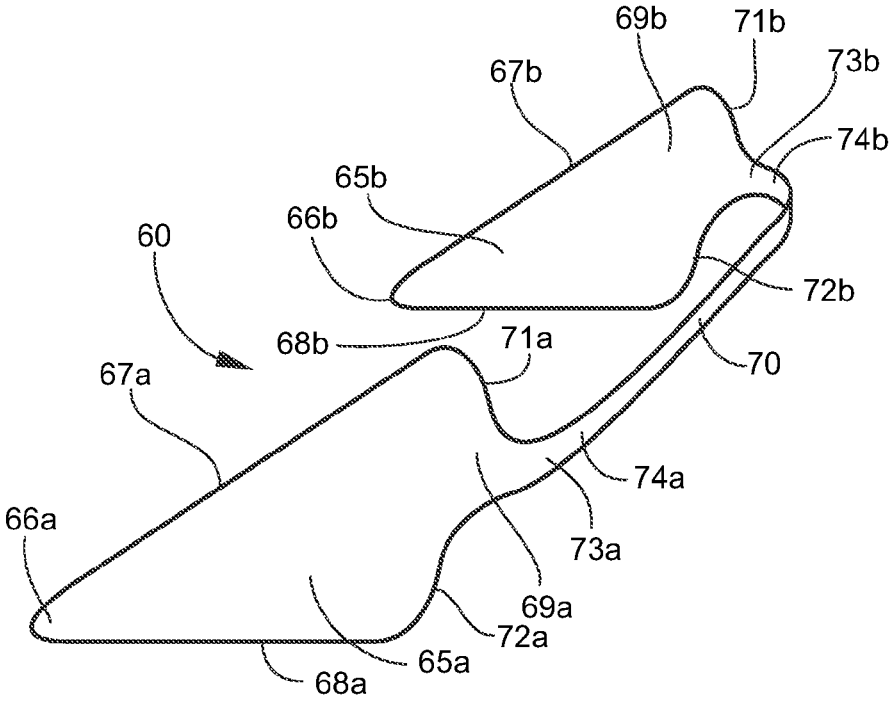
FIG. 3 illustrates a perspective view of a handle with integrated side panels of the cushion cover according to an embodiment herein.

FIG. 3, with reference to FIGS. 1 and 2, illustrates a perspective view of a handle 60 of the cushion cover 10 according to an embodiment herein. The handle 60 comprises a longitudinal strap 70 that connects the pair of side panels 65*a*, 65*b*. The handle 60 not only facilitates a mechanism to conveniently carry the cover 10, it also provides a structure for enclosing the sides of the cover 10 by way of the pair of side portions 65*a*, 65*b* such that the pair of side portions 65*a*, 65*b* are HF welded to the first chamber 15 on the sides.

Side panel 65*a* includes a pointed end 66*a* that is dimensioned and configured to match the contour of spine 18 of the first chamber 15. Side panel 65*a* further includes an angled top edge 67*a* and an oppositely positioned and substantially straight bottom edge 68*a*. Side panel 65*a* further includes a back end 69*a* oppositely positioned from the pointed end 66*a*. The back end 69*a* is thicker in height than the pointed end 66*a* such that the overall shape of side panel 65*a* is triangular/wedge-shape. The back end 69*a* further includes an upper back edge 71*a* and a lower back edge 72*a* that are separated by a first side portion 73*a* of the longitudinal strap 70. A first corner 74*a* of the longitudinal strap 70 allows the first side portion 73*a* to be substantially orthogonally positioned with respect to the longitudinal strap 70.

Side panel 65*b* includes a pointed end 66*b* that is dimensioned and configured to match the contour of spine 18 of the first chamber 15. Side panel 65*b* further includes an angled top edge 67*b* and an oppositely positioned and substantially straight bottom edge 68*b*. Side panel 65*b* further includes a back end 69*b* oppositely positioned from the pointed end 66*b*. The back end 69*b* is thicker in height than the pointed end 66*b* such that the overall shape of side panel 65*b* is triangular/wedge-shape. The back end 69*b* further includes an upper back edge 71*b* and a lower back edge 72*b* that are separated by a second side portion 73*b* of the longitudinal strap 70. A second corner 74*b* of the longitudinal strap 70 allows the first side portion 73*b* to be substantially orthogonally positioned with respect to the longitudinal strap 70. In one embodiment, the longitudinal strap 70 may be integrated into the pair of side panels 65*a*, 65*b* by means of tapering, which would eliminate edges 71*a*, 71*b*, 72*a*, 72*b*, in this configuration.

Figure 4:
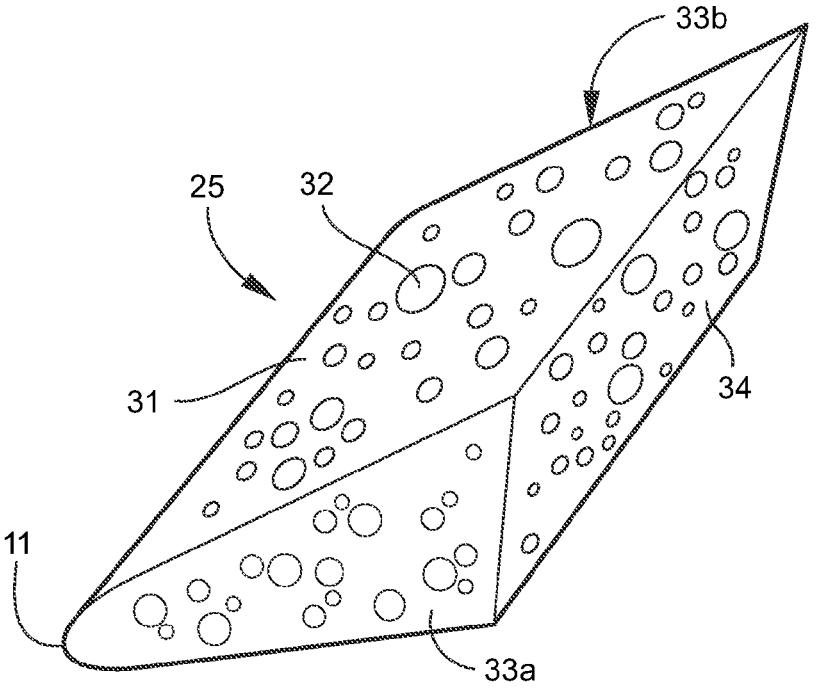
FIG. 4 illustrates a perspective view of a foam cushion according to an embodiment herein.

FIG. 4, with reference to FIGS. 1 through 3, illustrates a perspective view of the foam cushion 25 according to an embodiment herein. The foam cushion 25 comprises a pointed end 11 that is dimensioned and configured to match the contour of spine 18 of the first chamber 15 such that when the foam cushion 25 is inserted into the first chamber 15 the pointed end 11 snugly fits against the spine 18. The foam cushion 25 further includes an angled top portion 31, a pair of side portions 33*a*, 33*b*, and a back portion 34 such that the overall shape of the side portions 33*a*, 33*b* is triangular/wedge-shape. The back portion 34 is positioned opposite to the pointed end 11 such that the overall shape of the foam cushion 25 is triangular/wedge-shape. The foam cushion 25 further comprises a plurality of air pockets 32. According to one embodiment, an elastomer liner may be utilized for the foam cushion 25. An elastomer liner can be used to protect the foam cushion 25 from trace levels of moisture vapor transmission which may occur over time.

Figure 5:
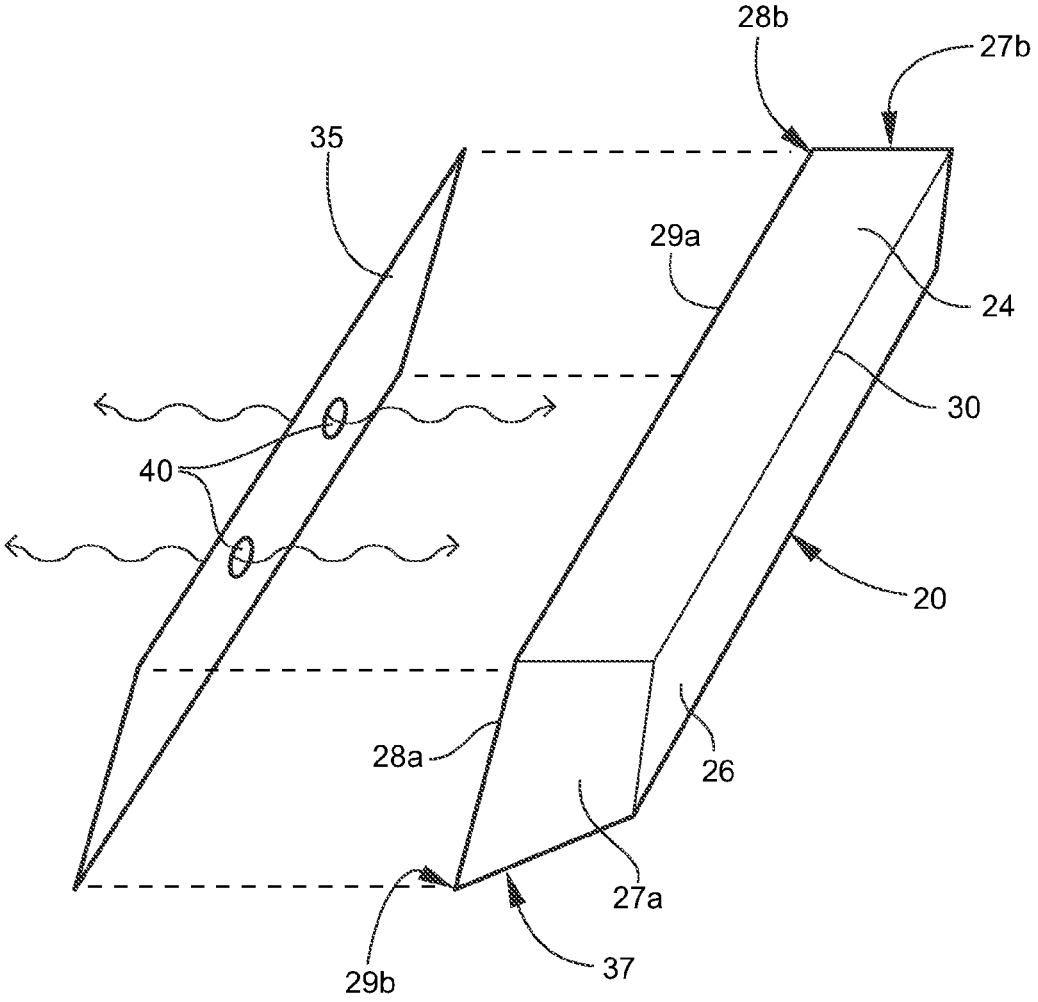
FIG. 5 illustrates a perspective view of a panel of the first chamber along with a second chamber of the cushion cover of FIG. 1 according to an embodiment herein.

FIG. 5, with reference to FIGS. 1 through 4, illustrates a perspective view of a panel 35 of the first chamber 15 along with a second chamber 20 according to an embodiment herein. The panel 35 of the first chamber 15 comprises at least one small hole 40, which permits the passage of air in both directions (as indicated by the curved arrows in FIG. 5). The panel 35 is configured to attach to the lateral edges 22, 23 of the pair of sheets 16, 17 of the first chamber 15. In one embodiment, the first sheet 16, second sheet 17, spine 18, and panel 35 could be made of one piece of fabric with one seam connecting them into a sheath, into which the cushion 25 could be inserted.

Figure 6A:
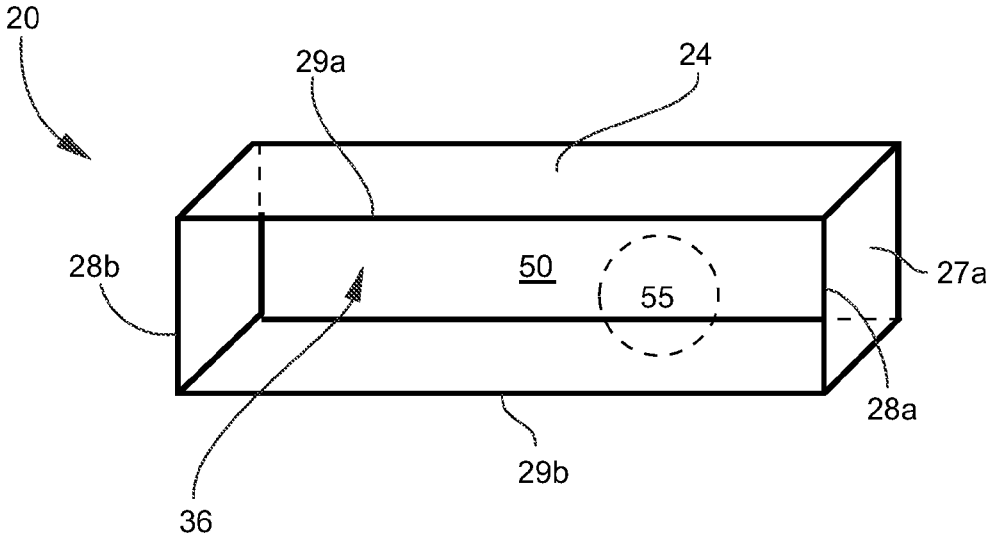
FIG. 6A illustrates a perspective front view, as viewed from a high angle, of the second chamber according to an embodiment herein.
Figure 6B:
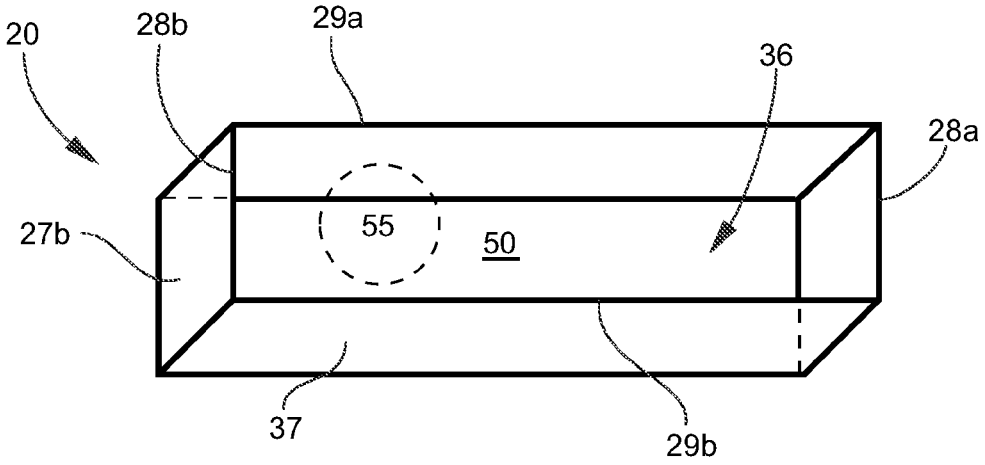
FIG. 6B illustrates a perspective front view, as viewed from a low angle, of the second chamber according to an embodiment herein.

As indicated in FIGS. 5, 6A, and 6B, with reference to FIGS. 1 through 4, further illustrates the second chamber 20 according to an embodiment herein, wherein the second chamber 20 comprises a closed back end 26, a closed top 24, a closed bottom 37, a pair of closed sides 27*a*, 27*b*, and an open front end 36. Generally, the second chamber 20 is configured in an open-box configuration. The closed back end 26 has a front surface 50 that is exposed to the open front end 36. The second chamber 20 comprises a front upper edge 29*a* and a front lower edge 29*b* along with a front first side edge 28*a* and a front second side edge 28*b*.

Figure 6C:
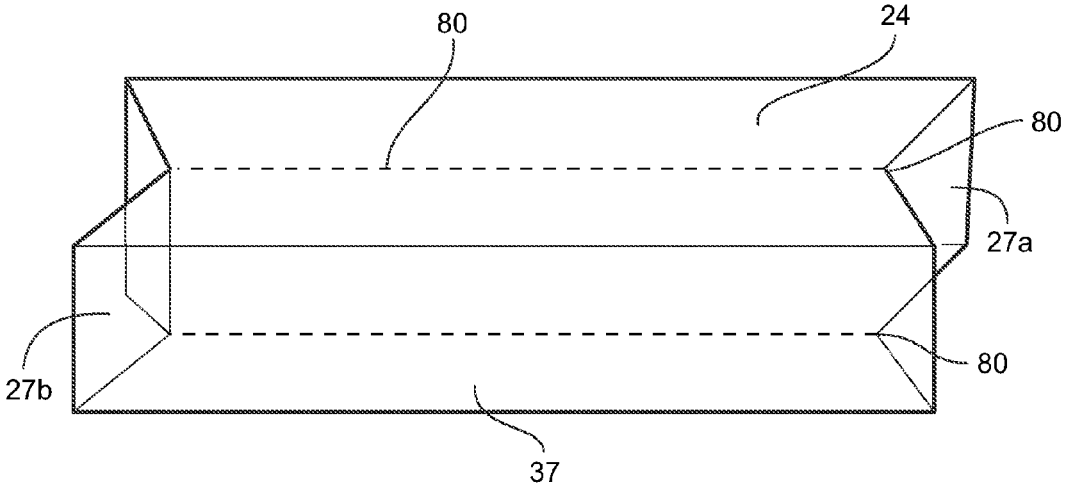
FIG. 6C illustrates a perspective front view of the second chamber according to another embodiment herein.

The second chamber 20 is also constructed with HF weldable elastomer materials joined by HF welded seams 30. The second chamber 20 is welded to the panel 35 of the first chamber 15 that has the air displacement hole(s) 40 such that the panel 35 is welded to the second chamber 20 at edges 28*a*, 28*b*, 29*a*, 29*b* thereby creating an air reservoir 55 defined by the space in between panel 35, sides 27*a*, 27*b*, top 24, bottom 37, and back end 26 (FIGS. 6A and 6B depict reservoir 55 in the dashed circle, however reservoir 55 includes the entirety of the inner box area defined by the second chamber 20). During manufacturing, when the second chamber 20 is welded onto the panel 35, the second chamber 20 is flattened to prevent it from holding air. After the panel 35 is welded onto the first chamber 15 that houses the cushion 25, the reservoir 55 provides the space for the displacement of air from the foam cushion 25 from inside the first chamber 15 upon a force being applied to the first chamber 15. As shown in FIG. 6C, one or more folds 80 may be configured into panels 24, 37, 27*a*, 27*b*, which will help the second chamber 20 to lie flat when the foam cushion 25 is not being compressed.

When weight from the part of the body being supported by the cushion 25 compresses the foam cushion 25, air is displaced into the reservoir 55 and held there until the weight is removed. When the weight is removed, a vacuum is created by the open cell structure of the foam cushion 25 and the air will be drawn back into the foam cushion 25 from the displacement reservoir 55. Because the entire cover 10, including both chambers 15, 20, is sealed by HF welding, there is no potential for contact with fluids or air in the surrounding ambient environment.

This closed system cover 10 allows for more effective cleaning of the cushion 25. The entire cushion 25 can be immersed into a fluid cleaning solution without the risk of permeation through seams, zipper enclosures, or vents. Full immersion into a fluid is also an effective means of determining if the cover 10 has been damaged or compromised in any way by the emergence of air bubbles from inside the cushion 25.

The type of cushion 25 provided by the embodiments herein comprises a foam patient positioning wedge, but the configuration of the cover 10 can be used on any type of cushion that uses polyurethane foam as the means of support. FIGS. 7 through 13, with reference to FIGS. 1 through 6C, illustrate examples of other types of cushions and air displacement chambers and systems according to various embodiments herein. In these embodiments, the air displacement chambers are externally situated chambers that outwardly extend away from the cushion, and may be configured as square, rectangular, tube-like, circular/button-like, wedge-shaped, among other configurations. Examples of other cushions include mattresses, wheelchair cushions, leg elevation cushions, arm supports, and pillows, among others.

Figure 7:
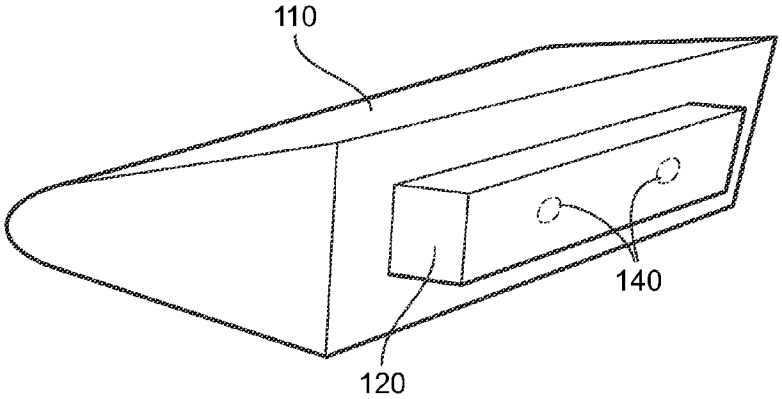
FIG. 7 illustrates a perspective view of a cushion cover according to another embodiment herein.
Figure 8A:
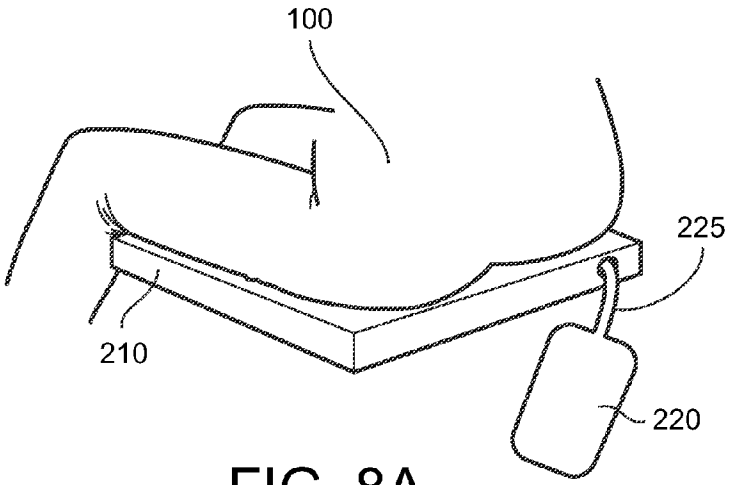
FIG. 8A illustrates a perspective view of a cushion air displacement system according to another embodiment herein.
Figure 8B:
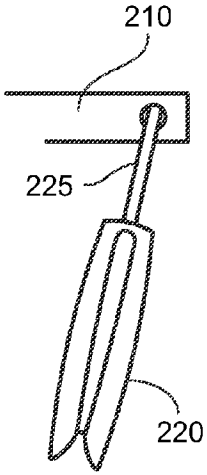
FIG. 8B illustrates a perspective view of an empty air displacement chamber of the cushion air displacement system of FIG. 8A according to an embodiment herein.
Figure 8C:
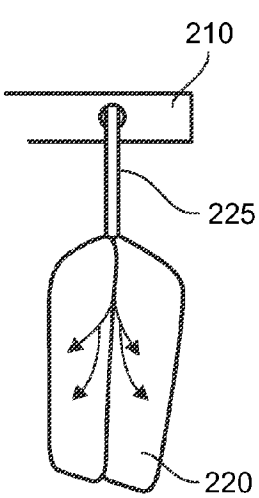
FIG. 8C illustrates a perspective view of the air displacement chamber of FIG. 8B filling with air according to an embodiment herein.
Figure 9:
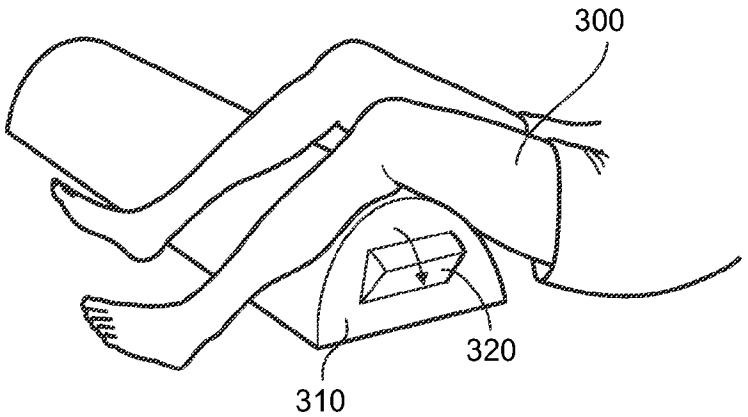
FIG. 9 illustrates a perspective view of a cushion cover according to still another embodiment herein.
Figure 11:
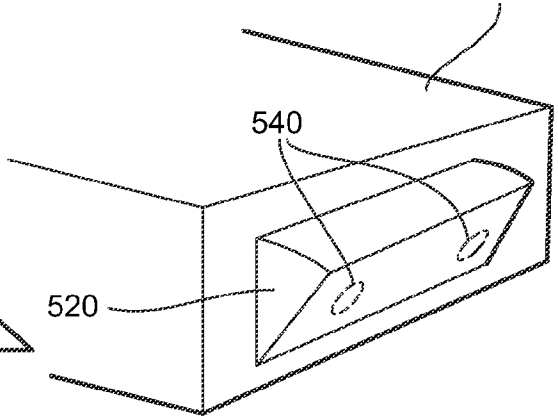
FIG. 11 illustrates a perspective view of a cushion air displacement system according to yet another embodiment herein.
Figure 10A:
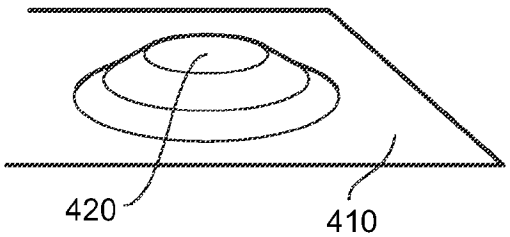
FIG. 10A illustrates a perspective view of a cushion air displacement system according to still another embodiment herein.
Figure 10B:
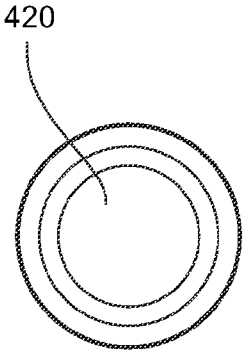
FIG. 10B illustrates a top view of the cushion air displacement system of FIG. 10A according to an embodiment herein.
Figure 12:
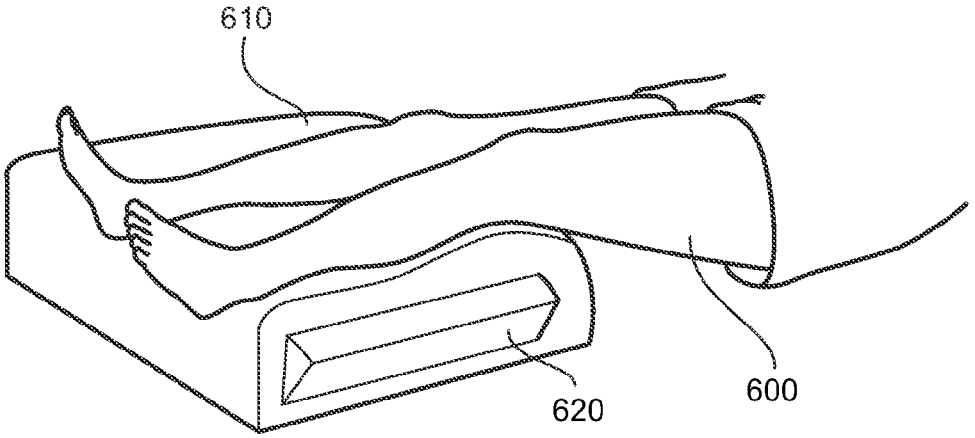
FIG. 12 illustrates a perspective view of a cushion cover according to still another embodiment herein.
Figure 13:
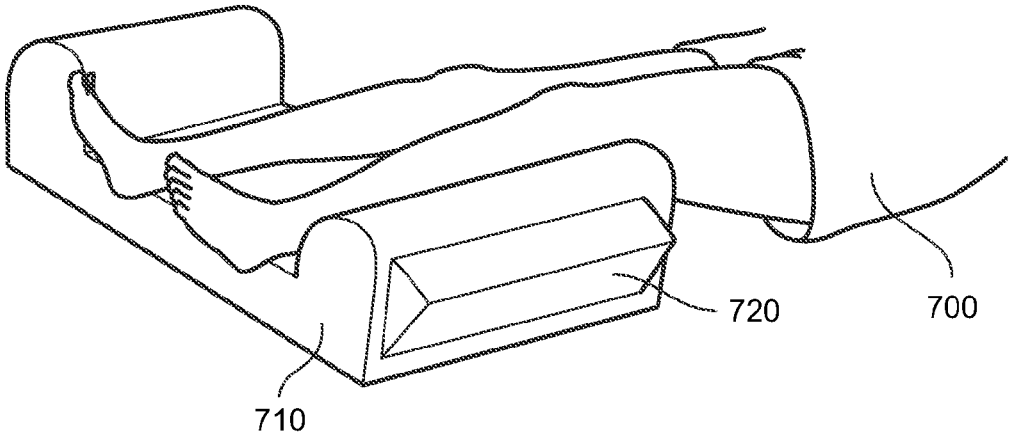
FIG. 13 illustrates a perspective view of a cushion cover according to yet embodiment herein.

FIG. 7 shows a substantially rectangular and externally configured air displacement chamber 120 connected to a cover 110, with the air displacement chamber 120 comprising holes 140 for passing air into the displacement chamber 120. The holes 140 are shown in dashed/phantom lines in FIG. 7 to indicate their placement at the cover 110/displacement chamber 120 interface. In other words, the holes 140 are not configured to allow air to pass outside the displacement chamber 120. FIG. 8A shows a user 100 sitting on a wheelchair cushion cover 210. The air displacement chamber 220 is configured as a remote displacement chamber connected by a tube 225 to the cover 210. FIG. 8B, with reference to FIG. 8A, illustrates an empty chamber 220. FIG. 8C, with reference to FIGS. 8A and 8B, illustrates a chamber 220 filled with air (the arrows in FIG. 8C represent the flow of air to fill the chamber 220). FIG. 9 shows a substantially half-barrel shaped cushion cover 310 with an external air displacement chamber 320. The cushion cover 310 may be used as a knee holster by a user 300. FIG. 10A shows a substantially circular air expansion chamber 420 connected to a cushion cover 410. In FIG. 10A, air is filling the chamber 420 thereby creating an outwardly protruding bump from the cover 410. FIG. 10B, with reference to FIG. 10A, illustrates a top view of the substantially circular air expansion chamber 420. FIG. 11 shows a substantially wedge-shaped air expansion chamber 520 connected to a cushion cover 510, with the air displacement chamber 520 comprising holes 540 for passing air into the displacement chamber 520. The holes 540 are shown in dashed/phantom lines in FIG. 11 to indicate their placement at the cover 510/displacement chamber 520 interface. In other words, the holes 540 are not configured to allow air to pass outside the displacement chamber 520. FIG. 12 shows a substantially square or rectangular shaped cushion cover 610 with an external air displacement chamber 620. The cushion cover 610 may be used as a leg elevation cushion by a user 600. FIG. 13 shows a substantially U-shaped cushion cover 710 with an external air displacement chamber 720. The cushion cover 710 may be used by a user 700 in a manner described in U.S. Pat. No. 6,634,045, the complete disclosure of which, in its entirety, is herein incorporated by reference.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of preferred embodiments, those skilled in the art will recognize that the embodiments herein can be practiced with modification within the spirit and scope of the appended claims.

What is claimed is:

1. A cushion cover comprising:

a first chamber comprising at least one sheet, wherein said first chamber is configured to house a cushion comprising air pockets;

a second chamber sealed to said first chamber, wherein said second chamber comprises a closed back end, a closed top, a closed bottom, a pair of closed sides, and an open front end;

a panel sealed to said first chamber and facing said open end of said second chamber, wherein said panel comprises at least one hole; and a handle comprising a longitudinal strap adjoining a pair of side panels, wherein said pair of side panels are sealed to said first chamber, wherein upon a force being applied to said first chamber, air contained in said air pockets of said cushion flows through said at least one hole in said panel and into said second chamber without exiting said second chamber, and wherein upon said force being removed from said first chamber, said air contained in said second chamber flows through said at least one hole in said panel and into said air pockets of said cushion.

2. The cover of claim 1, further comprising a plurality of edges along said first chamber, said second chamber, said panel, and said pair of side panels of said handle, wherein said plurality of edges are joined together by high frequency (HF) welding.

3. The cover of claim 2, wherein said open end of said second chamber comprises a thickness defined by a width of said closed top, said closed bottom, and said pair of closed sides of said second chamber.

4. The cover of claim 3, wherein said thickness is sufficiently configured to retain expelled air from said cushion without causing said plurality of edges to be opened.

5. The cover of claim 1, wherein each of said first chamber, said second chamber, said panel, and said handle comprise high frequency (HF) weldable elastomer material.

6. The cover of claim 1, wherein said cushion comprises any of a wedge shape, a rectangular shape, a square shape, and a semi-cylindrical shape.

7. The cover of claim 1, wherein said at least one sheet is devoid of any openings.

8. The cover of claim 1, wherein each of said first chamber, said second chamber, said panel, and said handle comprise translucent material.

9. The cover of claim 1, wherein said second chamber comprises any of a square shape, a rectangular shape, a wedge shape, and a circular shape.

10. A cushion cover comprising:

a first chamber configured to completely house a cushion, wherein said cushion comprises air pockets;

a panel sealed to said first chamber and comprising at least one hole; and a second chamber sealed to any of said panel and said first chamber, wherein said second chamber comprises a collapsible reservoir, wherein upon a force being applied to said first chamber, air contained in said air pockets of said cushion flows through said at least one hole in said panel and into said reservoir of said second chamber without exiting said second chamber, and wherein upon said force being removed from said first chamber, said air contained in said reservoir of said second chamber flows through said at least one hole in said panel and into said air pockets of said cushion.

11. The cover of claim 10, further comprising a plurality of edges along said first chamber, said second chamber, and said panel, wherein said plurality of edges are joined together by high frequency (HF) welding.

12. The cover of claim 10, further comprising a handle comprising a longitudinal strap adjoining a pair of side panels, wherein said pair of side panels are sealed to said first chamber.

13. The cover of claim 10, wherein said reservoir is sufficiently configured to retain expelled air from said cushion without causing said second chamber to be opened.

14. The cover of claim 10, wherein each of said first chamber, said second chamber, and said panel comprise high frequency (HF) weldable elastomer material.

15. The cover of claim 10, wherein said cushion comprises any of a wedge shape, a rectangular shape, a square shape, and a semi-cylindrical shape.

16. The cover of claim 10, wherein said first chamber is devoid of any openings.

17. The cover of claim 10, wherein each of said first chamber, said second chamber, and said panel comprise translucent material.

18. The cover of claim 10, wherein said second chamber comprises any of a square shape, a rectangular shape, a wedge shape, and a circular shape.

19. A cushion cover comprising:

a first chamber devoid of any openings and configured to completely house a cushion, wherein said cushion comprises air pockets;

a panel sealed to said first chamber and comprising at least one hole; and a second chamber sealed to any of said panel and said first chamber, wherein said second chamber comprises a collapsible reservoir, wherein upon a force being applied to said first chamber, air contained in said air pockets of said cushion flows through said at least one hole in said panel and into said reservoir of said second chamber without exiting said second chamber.

20. The cover of claim 19, wherein upon said force being removed from said first chamber, said air contained in said reservoir of said second chamber flows through said at least one hole in said panel and into said air pockets of said cushion.

* * * * *